US007714253B2

(12) United States Patent
Machrowicz

(10) Patent No.: US 7,714,253 B2
(45) Date of Patent: May 11, 2010

(54) METHOD AND APPARATUS FOR THE UNIFORM RESISTANCE HEATING OF ARTICLES

(75) Inventor: Tad Machrowicz, Ortonville, MI (US)

(73) Assignee: Noble Advanced Technologies, Inc., Warren, MI (US)

( * ) Notice: Subject to any disclaimer, the term of this patent is extended or adjusted under 35 U.S.C. 154(b) by 456 days.

(21) Appl. No.: 11/685,877

(22) Filed: Mar. 14, 2007

(65) Prior Publication Data

US 2007/0215588 A1 Sep. 20, 2007

Related U.S. Application Data

(60) Provisional application No. 60/782,801, filed on Mar. 16, 2006.

(51) Int. Cl.
*H05B 3/00* (2006.01)

(52) U.S. Cl. ..... 219/162; 219/50

(58) Field of Classification Search ..... 219/50, 219/162

See application file for complete search history.

(56) References Cited

U.S. PATENT DOCUMENTS 1,979,111 A 10/1934 Kalschne
2,972,043 A 2/1961 Stich
3,737,616 A 6/1973 Amosky
3,737,618 A * 6/1973 Arnosky ..... 219/156
3,805,697 A 4/1974 Gray
5,916,389 A 6/1999 Lundstrom et al.
6,897,407 B2 5/2005 Gomez et al.
6,903,296 B2 6/2005 Gomez et al.
7,429,711 B2 * 9/2008 Machrowicz ..... 219/50
2003/0217991 A1 * 11/2003 Gomez ..... 219/50

* cited by examiner

*Primary Examiner*—Kevin P Kerns
(74) *Attorney, Agent, or Firm*—Gifford, Krass, Sprinkle, Anderson & Citkowski, P.C.

(57) ABSTRACT

A method for providing a controlled heating profile in an article being heated in a resistance heating process is provided. The method includes contacting the article with a plurality of electrodes, selecting a first correlated group that includes at least two electrodes, and establishing a flow of electrical current between the electrodes of the first correlated group. The method also includes selecting a second correlated group that includes at least two electrodes, the second correlated group differing from the first correlated group. A flow of electrical current is also established between the electrodes of the second correlated group for the purpose of providing a controlled heating profile for an article undergoing resistance heating.

26 Claims, 4 Drawing Sheets

METHOD AND APPARATUS FOR THE UNIFORM RESISTANCE HEATING OF ARTICLES

CROSS-REFERENCE TO RELATED APPLICATIONS

This application claims priority of U.S. Provisional Patent Application Ser. No. 60/782,801 filed Mar. 16, 2006, entitled "Method and Apparatus for the Uniform Resistance Heating of Articles," which is incorporated herein by reference.

FIELD OF THE INVENTION

This invention relates generally to resistance heating. More specifically, the invention relates to methods and apparatus for uniformly heating irregularly shaped articles by electrical resistance beating.

BACKGROUND OF THE INVENTION

Electrical resistance heating is an effective and energy efficient method for heating electrically conductive articles, such as metal workpieces. In this process, an electrical current is flowed through the workpiece. By controlling the magnitude of the current, the amount of heating may be readily regulated.

In general, resistance heating methods provide for a reliable and uniform beating of workpieces; however, particular problems can be presented by workpieces which have an irregular shape or include openings, thinned portions, or other features therein. These irregularities can disrupt the current path and prevent uniform heating from occurring. For example, openings can result in a concentration of current proximate their perimeters, and thereby cause hotspots. Likewise, a thinned cross-sectional or transverse portion of an article can concentrate current and create hotspots. Establishing a uniform flow of current through an irregularly shaped workpiece is often difficult, since current tends to take the shortest path through the workpiece; and hence, particular regions may be "shaded" and under heated. This problem is particularly significant when relatively thin workpieces, such as structural components of motor vehicles, are being fabricated.

In response to the above stated problem, Arnosky in U.S. Pat. No. 3,737,618 disclosed a two-stage process for heating a slotted tube. In a first stage of the process, four sets of electrodes are attached to the end portions of the tube and energized in order to preheat the end regions. In a second stage, two of the sets of electrodes are removed from the tube so that the end regions and the slot-like area are heated simultaneously. Also, Gomez, in U.S. Pat. No. 6,897,407, discloses a two-stage process in which a first set of electrodes preheat a workpiece while a second set of shunting electrodes allows current to bypass small cross section regions of the workpiece. The first stage involves passing current through the workpiece with the smaller regions conductively bridged so that said regions were heated to a lesser extent. In the second stage, the shunting electrodes are removed and the entire workpiece is heated.

Both of the above prior art methods involve multiple stage processing on symmetrical workpieces. Hence, these systems cannot provide the control necessary for beating highly irregular pieces; and, the two-stage nature of the prior art processes complicates their use in high-speed automated processes. Thus, it will be appreciated that there is a need for a one-stage method and apparatus whereby electrical resistance heating may be utilized to uniformly heat workpieces which include irregular features and wherein a measured parameter of the workpiece aids in controlling the heating system. As will be explained in detail hereinbelow, the present invention meets this need.

SUMMARY OF THE INVENTION

A method for providing a controlled heating profile in an article being heated in a resistance heating process is provided. The method includes contacting the article with a plurality of electrodes, selecting a first correlated group that includes at least two electrodes, and establishing a flow of electrical current between the electrodes of the first correlated group. The method also includes selecting a second correlated group that includes at least two electrodes, the second correlated group differing from the first correlated group. A flow of electrical current is also established between the electrodes of the second correlated group for the purpose of providing a controlled heating profile for an article undergoing resistance heating.

The electrical current between the electrodes of the second correlated group can be established after the flow of electrical current is established between the electrodes of the first correlated group. In addition, the flow of electrical current between the electrodes of the first correlated group can be terminated before the flow of the electrical current is established between the electrodes of the second correlated group. The method can also include the further step of selecting a third correlated group comprised of at least two of the said plurality of electrodes and establishing a flow of electrical current between the electrodes of the third correlated group.

A step of controlling at least one sequence, duration, and magnitude of current flow between the electrodes of the various correlated groups can be included. In addition, the flow of current between the electrodes of the various correlated groups can be controlled by a preselected program. The flow of current can also be controlled by a response to a measured parameter of the article, for example the temperature and/or electrical resistance of the article. Bridging members can be used to control current flow in the region of openings and/or thinned portions of the workpiece.

DETAILED DESCRIPTION OF TEE INVENTION

As detailed above, it is frequently difficult to establish a uniform current flow through irregularly shaped workpieces. The present invention provides a multi-electrode system and method wherein a plurality of electrodes are affixed to a workpiece and correlated groups of these electrodes are energized in accord with various sequences to uniformly beat the workpiece.

Figure 1:
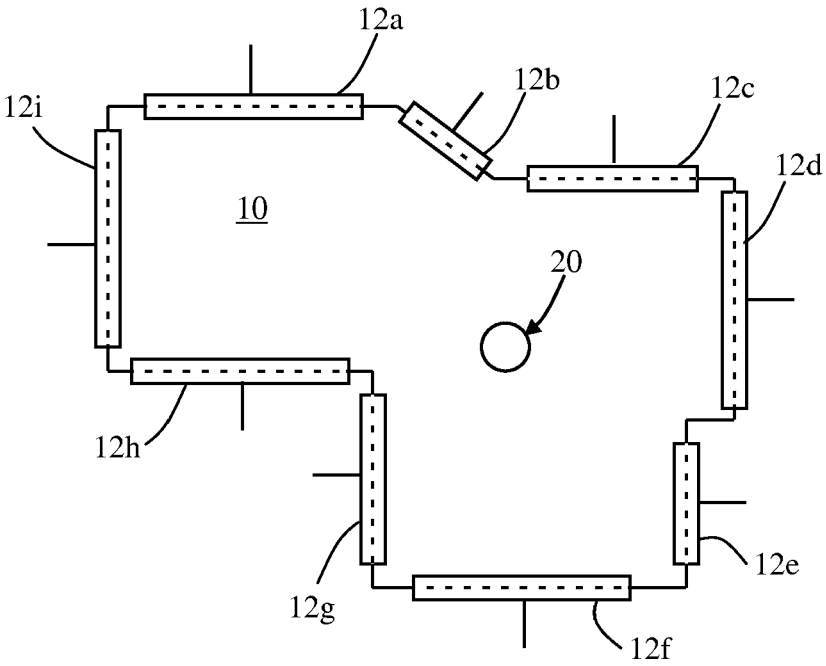
FIG. 1 is a top view of an article with electrodes attached thereto according to the present invention.

Referring now to FIG. 1, there is shown one particular implementation of the present invention, as used to heat an irregularly shaped workpiece 10. The workpiece is contacted by a series of electrodes 12*a*-12*i* which are affixed to the perimeter of the workpiece 10. Each of the electrodes 12*a*-12*i* is selectively connectable to a source of electrical current and/or a ground. The selectable connection may be established through a switchboard, a controller, or the like, as will be apparent to those of skill in the art.

Figure 2:
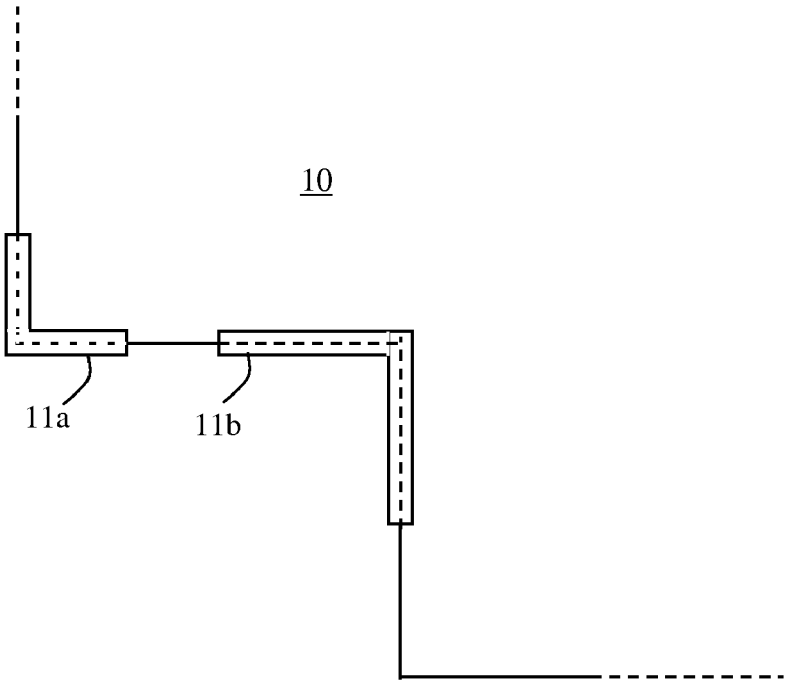
FIG. 2 is a top view of a corner electrode according to the present invention.

In the operation of the present invention, groups of these electrodes, such groups termed herein "correlated groups," are selectively energized so that current flow through the workpiece may be controlled and directed. For example, electrodes 12*a* and 12*f* may be energized so as to cause an electrical current to flow along substantially all of the width of the workpiece 10. This current path may not adequately heat the corner of the workpiece in the region of electrodes 12*c* and 12*b*, and this area may be heated by a current established between electrodes 12*b* and/or 12*c* and 12*f*. Similarly, this region could be heated by a current passing between electrodes 12*i* and 12*d*. In some instances, a current path may be established by utilizing more than two electrodes. For example, a current path between electrode 12*b* and each of 12*i* and 12*h* could be utilized to heat the region in that corner of the workpiece. In the alternative an electrode designed to fit corners such as a corner electrode 11*a* and/or 11*b* shown in FIG. 2 can be utilized to heat a corner region of the workpiece. In the use of the present invention, various combinations of electrodes may be energized in sequence, and in some instances simultaneously, so as to quickly and efficiently bring the workpiece 10 to a uniform temperature. Control of the timing, duration and magnitude of the current pulses applied to the workpiece may be adjusted in accord with measured parameters, or a stored program such as to provide and maintain a uniform temperature in the workpiece. It is appreciated from FIG. 1 that the electrodes 12*a*-12*i* remain in contact with the workpiece 10 during an energizing sequence.

Figure 3:
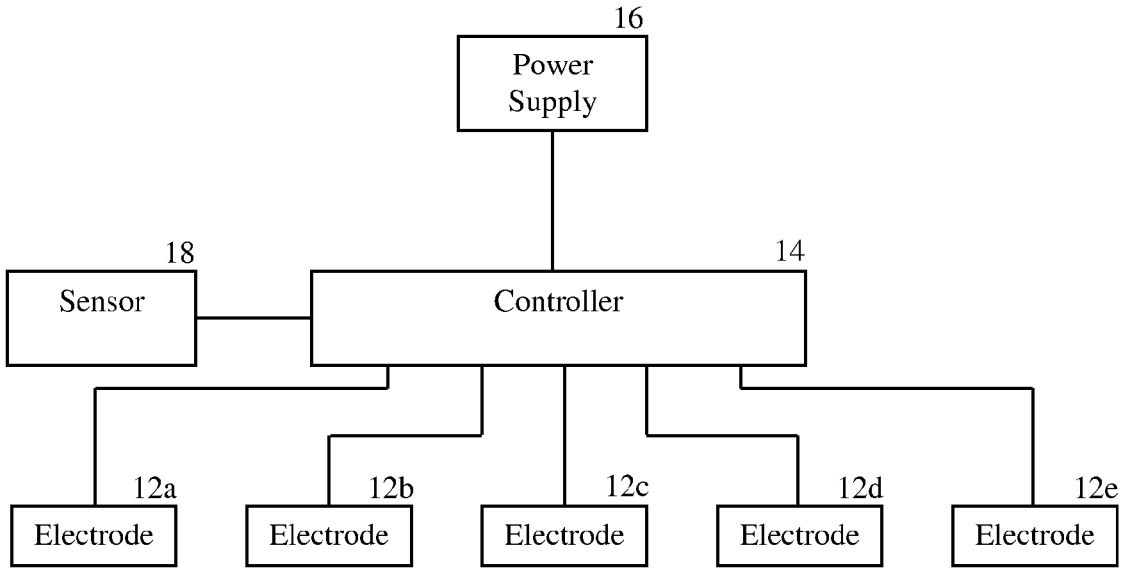
FIG. 3 is a schematic diagram of a controller, a series of electrodes, a power supply and a sensor according to the present invention.

Referring now to FIG. 3, there is shown another feature of the present invention comprising a controller 14 which is in communication with a plurality of electrodes 12*a*-12*e* and a power supply 16. The controller 14 operates to selectively energize various groups of the electrodes 12*a*-12*e* via the power supply 16 so as to carry out the method of the present invention and can be operable to control at least one of the sequence, duration and/or magnitude of current flow between the electrodes of the various/correlated groups. The controller may also energize the electrodes in accord with a preselected program stored therein.

In other instances, the system further includes a sensor, such as a temperature sensor 18 which is also in communication with the controller. The temperature sensor may be an optical pyrometer, an infrared sensitive camera, a thermocouple array, or any other such device operative to sense the temperature of the workpiece and provide a control signal which enables the controller to appropriately control the energization of the electrodes. In particular instances, the temperature sensor provides a signal indicative of the distribution of thermal energy in the workpiece. This signal carries information indicative of hotspots and cool areas in the workpiece, and by appropriately reading this signal, the controller can selectively energize and de-energize particular groups of electrodes so as to provide and maintain a desired temperature profile across the device. Typically, this profile will be a uniform temperature profile; however, in some instances, there may be a need for maintaining a preselected non-uniform profile, and such may be accomplished by the present system.

As is known in the art, a number of parameters or physical properties of a body of metal will vary as a function of the temperature of that metal, and such parameters may be sensed and used as part of the control system of the present invention. For example, metals exhibit an increase in electrical resistance as their temperature increases. The spatial profile of the electrical resistance of the workpiece may be readily measured and used to control heating. For example, the aforementioned electrodes may also function as probes for measuring resistance in the workpiece and thus function as a sensor array. Magnetic properties of iron and other ferromagnetic alloys also vary as a function of their temperature, and these properties may also be measured and similarly used to provide a control signal.

In those instances where a batch of similarly configured workpieces are sequentially processed, a set of control profiles may be established on the basis of analyzing one, or a relatively small number of, workpieces, and these profiles can be stored in the controller and used for processing subsequent workpieces without requiring discreet temperature measurements for each.

The presence of a thinned or otherwise narrowed portion of a hole or other opening in a workpiece can present some particular problems in a resistive heating process. For example, workpiece 10 of FIG. 1 includes a hole 20 therein. Current flowing across the region having the hole 20 defined therein tends to concentrate at various points along the perimeter of the hole, thereby producing hotspots in some areas. In some instances, this problem can be alleviated by use of appropriate electrode groups which effectively "steer" current around the opening. However, in some instances, this approach is difficult or impractical. Therefore, in accord with a further aspect of the present invention, an electrically conductive filler member is disposed so as to shunt current across the opening and thereby provide for a uniform flux and consequent uniform heating.

Figure 4:
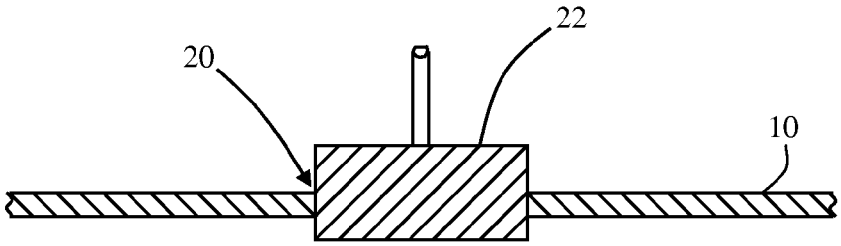
FIG. 4 is a side cross-sectional view of an article with a plug filler member according to the present invention.
Figure 5:
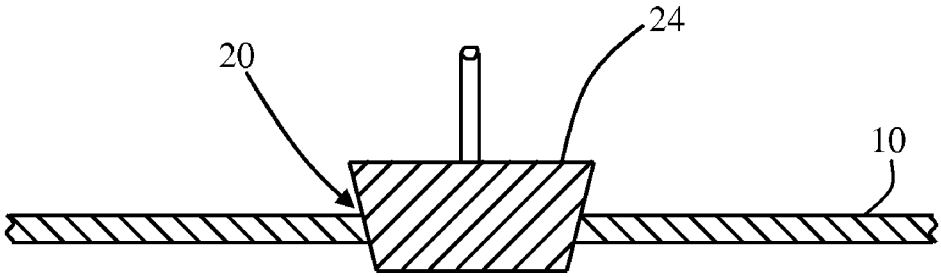
FIG. 5 is a side cross-sectional view of an article with a plug filler member according to the present invention.

Referring now to FIG. 4, there is shown a portion of the workpiece 10 with a filler member 22 disposed so as to fill the hole 20 and provide for current to flow there across. The filler member 22 may be made from any electrically conductive material, and preferably should be non-reactive with the workpiece. A filler member may be made to be thicker than the workpiece; although, relatively large filler members can cause heat sinking which may affect the temperature uniformity of the workpiece, and for this reason the heat capacity of the filler member should be taken into account in designing systems of the present invention. The filler member need not contact the entire periphery of the workpiece in all instances. The degree of contact will depend upon the direction of current flow and the nature of the opening itself. As illustrated in FIG. 4, the filler member 22 is shown as being in the form of a plug which may be raised and lowered to contact workpieces as they are introduced into the apparatus. As shown, the plug fits directly into the opening; however, in other instances, the plug may include a rim or other feature to aid in positioning and establishment of contact. For example, FIG. 5 shows a system in which the plug 24 is a tapered member.

Figure 6:
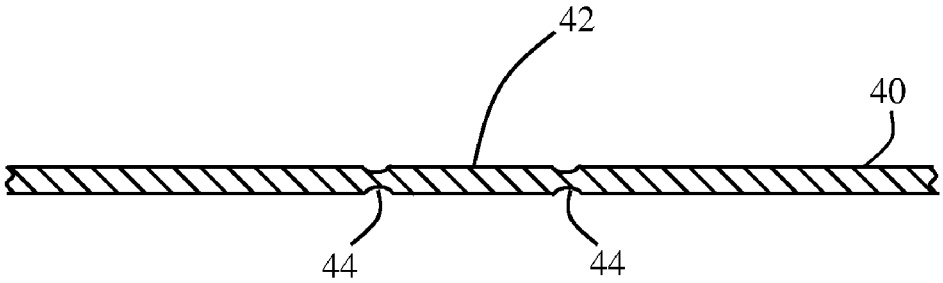
FIG. 6 is a side cross-sectional view of an article with an integral filler member according to the present invention.

According to the present invention, the filler member may be inserted into the workpiece before it is put into the apparatus, or it may be inserted after placing the workpiece in the apparatus. In some instances, the filler member is automatically placed and withdrawn from the workpiece by the apparatus. In yet other instances, the filler member may actually be a portion of the workpiece itself. In such instances, the filler member may be defined by a weakened portion of the workpiece held to the remainder of the workpiece by a thin, and in some instances, perforated web. Following heat treatment, this integral filler member may be removed by a punching operation or the like, and in some instances, this punching operation is preferably carried out while the workpiece is still at an elevated temperature, while in other instances, it may be carried out after hardening operations or the like. FIG. 6 shows a cross-section of a workpiece 40 having an integral filler member 42 retained thereupon by a thinned web portion 44.

Figure 7:
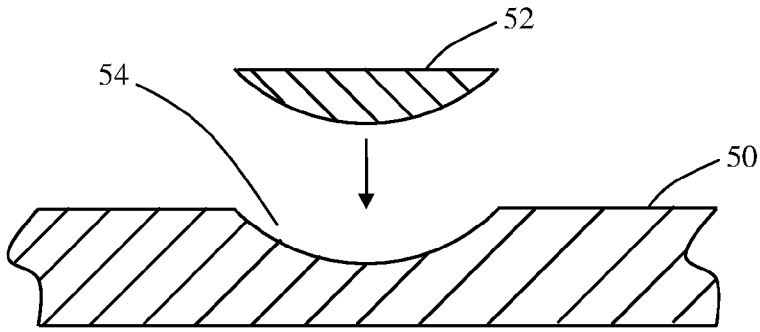
FIG. 7 is a side cross-sectional view of an article with a recessed portion and a filler member according to the present invention.

In some instances an article to be heated by resistance heating will have a recessed or cavity area within said article that creates a thinned region wherein non-uniform heating can occur. The present invention affords for uniform heating in such an area as shown in FIG. 7. An article 50 with a recessed area 54 is afforded uniform resistance heating proximate said recessed area 54 by insertion of a filler member 52. The filler member 52 is similar to the filler members 22 and 24 mentioned above and affords for electrical current to pass therethrough.

Figure 8:
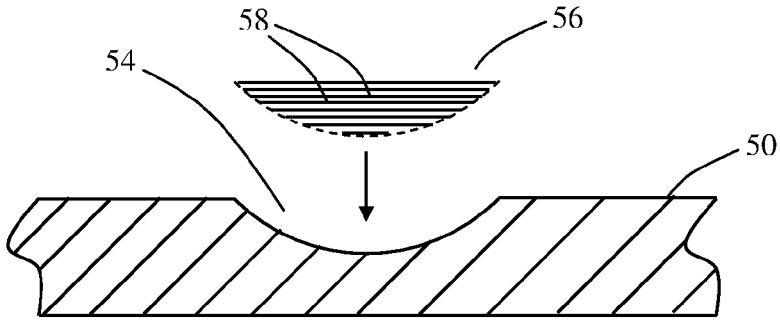
FIG. 8 is a side cross-sectional view of an article with a recessed portion and a filler member according to the present invention.

The recessed area 54 of the article 50 can also be bridged with a filler member 56 as shown in FIG. 8. The filler member 56 contains a plurality of wires or sheets 58 which span the distance, area and/or volume of the recessed region 54. The filler member 52 does likewise.

Figure 9:
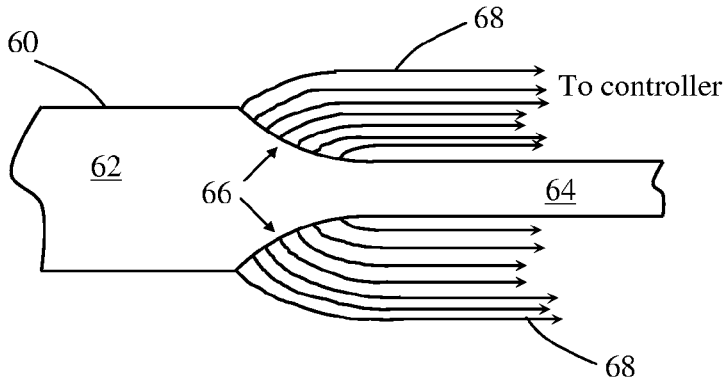
FIG. 9 is a side view of an article with a reduced cross-section and wire junctions attached thereto according to the present invention.

Turning to FIG. 9, a different embodiment of the present invention is shown wherein an article 60 has a reduction in cross section from a thick section 62 to a thin section 64. For example, and for illustrative purposes only, article 60 can be representative of a bolt, nail set punch or mechanical tensile sample undergoing a resistance heating heat treatment. The present invention affords for uniform heating along the article 60 by attaching a filler member comprising a plurality of bridging electrodes 68 to the area 66. The electrodes 68 attached to the area 66 can be in connection with the controller 14. One or more of the electrodes 68 can also serve as a sensor 18 (FIG. 3) wherein the temperature and/or electrical resistance of the area 66 is monitored.

In view of the teaching presented herein, it will be appreciated that other modifications and variations of this invention will be apparent to those of skill in the art. The foregoing drawings, discussion and description are illustrative of specific embodiments, but are not meant to be limitations upon the practice thereof. It is the following claims, including the equivalents, which define the scope of the invention.

I claim:

1. A method for providing a controlled heating profile in an article being heated in a resistance heating process, said method comprising the steps of:

providing an article having an irregular shaped perimeter to be resistance heated;

contacting the article with a plurality of electrodes, said plurality comprising at least three electrodes;

providing a controller operable to control current between said plurality of electrodes in accord with either a preselected program or a measured parameter of the article;

selecting a first correlated group comprising at least two of said plurality of electrodes;

establishing a flow of electrical current between the electrodes of said first correlated group;

selecting a second correlated group comprising at least two of said plurality of electrodes, said second correlated group differing from said first correlated group;

establishing a flow of electrical current between the electrodes of the second correlated group; and controlling the flow of electrical current between the electrodes of the first correlated group and the second correlated group with the controller in accord with the preselected program or a measured parameter of the article during a single stage resistance heating process wherein all of the plurality of electrodes remain in contact with the article, for the purpose of providing a controlled heating profile in the article being heated in the single stage resistance heating process.

2. The method of claim 1 wherein the flow of electrical current between the electrodes of the second correlated group is established after the flow of the electrical current is established between the electrodes of said first correlated group.

3. The method of claim 1 wherein the flow of electrical current between the electrodes of the first correlated group is terminated before the flow of electrical current is established between the electrodes of the second correlated group.

4. The method of claim 1 wherein the flow of electrical current between the electrodes of the first correlated group is terminated after the flow of electrical current is established between the electrodes of the second correlated group.

5. The method of claim 1 wherein the flow of electrical current between the electrodes of the first correlated group is terminated before the flow of electrical current between the electrodes of the second correlated group is terminated.

6. The method of claim 1 wherein said plurality of electrodes comprises more than three electrodes.

7. The method of claim 6, including the further step of selecting a third correlated group comprising at least two of said plurality of electrodes; and establishing a flow of electrical current between the electrodes of the third correlated group.

8. The method of claim 7 wherein the controller controls at least one of the sequence, duration, and magnitude of the current flow between the electrodes of said correlated groups.

9. The method of claim 8 wherein the controller controls said current flow in accord with a preselected program.

10. The method of claim 8, wherein the controller controls said current flow in response to a measured parameter of said article.

11. The method of claim 10, wherein said parameter comprises temperature.

12. The method of claim 10, wherein said parameter comprises spatial variation in temperature of said article.

13. The method of claim 10, wherein said parameter comprises electrical resistance of said article.

14. The method of claim 10, wherein said parameter comprises spatial variation in electrical resistance of said article.

15. The method of claim 1, wherein said article includes an opening or thinned portion defined thereupon and said method includes the further step of disposing an electrically conductive filler member in contact with said opening or thinned portion, said filler member being operative to conduct an electrical current across said opening or thinned portion.

16. A system for heating a workpiece having an irregular shaped perimeter, said system comprising:

a plurality of electrodes comprising at least three electrodes, said electrodes being configured to contact said workpiece;

a controller operative, when all of said plurality of electrodes are in contact with said workpiece, to selectively establish a single stage resistance heating process in accord with either a preselected program or a measured parameter of said workpiece:

I. a first flow of current between a first correlated group comprising at least two of said plurality of electrodes; and II. a second flow of current between a second correlated group comprising at least two of said plurality of electrodes.

17. The system of claim 16, wherein said controller is further operative to control at least one feature of said current flows, said feature selected from the group consisting of the sequence, timing, duration, magnitude and combinations thereof, of said current flows.

18. The system of claim 17, wherein said controller is operative to control said at least one feature in accord with a preselected program.

19. The system of claim 17, wherein said system includes a sensor which is operable to measure at least one physical property of said workpiece, and said controller is operable to control said at least one feature in accord with the measured physical property of said workpiece.

20. The system of claim 19, wherein said sensor is operative to measure temperature of said workpiece.

21. The system of claim 19, wherein said sensor is operative to measure spatial distribution of the temperature of said workpiece.

22. The system of claim 19, wherein said sensor is operative to measure electrical resistance of said workpiece.

23. The system of claim 19, wherein said sensor is operative to measure spatial distribution of electrical resistance of said workpiece.

24. The system of claim 16, wherein said workpiece includes an opening or thinned portion defined thereupon and said system includes an actuator operative to dispose an electrically conductive filler member so that said filler member is in contact with at least a portion of the perimeter of the opening or thinned portion so that a flow of electrical current may pass theracross.

25. A method for uniform resistance heating of a workpiece having an irregular shaped perimeter and an opening or thinned portion defined thereupon, said method comprising:

providing a workpiece having an irregular shaped perimeter and an opening or thinned portion;

providing a plurality of electrodes;

contacting the workpiece with the plurality of electrodes;

providing an electrically conductive filler member;

disposing said filler member in electrical communication with at least a portion of the perimeter of the opening or thinned portion in said workpiece; and establishing a flow of electrical current through said workpiece during a single stage resistance heating process wherein all of the plurality of electrodes are in contact with the workpiece, whereby said flow of current resistively heats said workpiece and said filler member allows at least a portion of said current to bypass said opening or thinned portion.

26. An apparatus for uniform resistance heating of a workpiece having an irregular shaped perimeter and an opening or thinned portion defined thereupon, said apparatus comprising:

a plurality of electrodes operative to contact and establish electrical communication with said workpiece;

a source of electrical current in electrical communication with said plurality of electrodes, said source of current being selectively operable to establish a flow of electrical current through said workpiece during a single stage resistance heating process wherein all of said plurality of electrodes are in contact with said workpiece which is in electrical communication with said plurality of electrodes; and an electrically conductive filler member configured to be disposed in electrical communication with at least a portion of the perimeter of an opening or thinned portion in said workpiece whereby when said electrical current is flowed through said workpiece, said filler member allows said at least a portion of said current to bypass said opening or thinned portion.

* * * * *